United States Patent [19]

Hendren et al.

[11] Patent Number: 4,940,512

[45] Date of Patent: Jul. 10, 1990

[54] CROSS-DIRECTIONAL DISTRIBUTION OF ADDITIVES IN SYNTHETIC PAPERS

[75] Inventors: Gary L. Hendren; Lee J. Hesler, both of Richmond, Va.

[73] Assignee: E. I. du Pont de Nemours and Co.ny, Wilmington, Del.

[21] Appl. No.: 233,634

[22] Filed: Aug. 18, 1988

[51] Int. Cl.[5] ..... D21H 23/02

[52] U.S. Cl. ..... 162/109; 162/146; 162/183; 162/188

[58] Field of Search ..... 162/109, 134, 146, 183, 162/188, DIG. 6, DIG. 11, 336, 338, 343

[56] References Cited

U.S. PATENT DOCUMENTS

| | | | |
|---|---|---|---|
| 2,999,788 | 9/1961 | Morgan | 162/146 |
| 3,493,463 | 2/1970 | Baker | 162/109 |
| 3,756,908 | 9/1973 | Gross | 162/146 |

*Primary Examiner*—Peter Chin

[57] ABSTRACT

A process for making a wet-laid, elongate, nonwoven flexible sheet having an additive distributed in a predetermined cross-directional pattern includes providing two synthetic fibrous stocks containing the additive in a concentration higher in one stock than in the other stock. The stocks are supplied to a paper machine having a headbox for depositing the stocks on a wire to form a wet sheet with the stocks being introduced into the headbox from a plurality of cross-directional positions equally spaced-apart along the headbox with a generally equal amount of solids being introduced at each position and with the stock with the higher concentration being introduced in higher quantity than the other stock at least at one cross-directional position so that the additive is distributed in the predetermined cross-directional pattern.

9 Claims, 6 Drawing Sheets

CROSS-DIRECTIONAL DISTRIBUTION OF ADDITIVES IN SYNTHETIC PAPERS

BACKGROUND OF THE INVENTION

The present invention relates to synthetic, wet-laid, nonwoven sheets and more particularly relates to synthetic, wet-laid, nonwoven sheets having an additive distributed in a cross-directional pattern across the sheets.

Various types of synthetic, wet-laid, nonwoven sheets such as papers and processes for making such sheets are known and are described in, for example, U.S. Pat. Nos. 2,999,788 and 3,756,908. As disclosed in U.S. Pat. No. 3,756,908, the papers produced from fibrids and floc of non-fusible, aromatic polyamides are particularly useful due to excellent thermal and electrical insulation properties.

For papers of the type disclosed in U.S. Pat. Nos. 2,999,788 and 3,756,908 and in other papers produced from synthetic fibrous stocks, it is desirable for some specialized end uses for an additive to be distributed in higher and lower additive quantities across the width of the sheet while being consistent along the sheet length, i.e., distributed in a "cross-direction" in the sheet. For example, in the manufacture of "honeycomb" structures from such papers, it is desirable for an additive or colorant to be distributed in the paper so that one face of the honeycomb contains the additive or colorant whereas the other face has a lower amount of such additive or colorant. In papers for making honeycomb and for other uses, it may be desirable for the additive to be entirely absent in some cross-directional areas of the sheet or for a particular cross-directional pattern of additive to be provided. A process is needed for producing such synthetic nonwoven sheets having additives distributed in a cross-direction in the sheet.

SUMMARY OF THE INVENTION

In accordance with the invention, a process is provided for making an elongate, nonwoven sheet from synthetic fibrous stocks. The sheets have an additive distributed in a predetermined cross-directional pattern of areas of higher and lower additive quantities across the width of the sheet. In the process, at least two synthetic fibrous stocks, each containing solids capable of forming an elongate, nonwoven flexible sheet, are provided, one of the stocks containing an additive in a concentration higher than in the other stock. Each of the stocks is supplied to a paper machine having a headbox for depositing the stocks on a wire to form a wet sheet of the solids. The stocks are introduced into the headbox from a plurality of cross-directional positions equally spaced-apart along the headbox with a generally equal amount of solids being introduced at each position to produce a wet sheet generally uniform in weight per unit area across its width. The stock with the higher concentration of additive is introduced in higher quantity than the other stock at least at one of the cross-directional positions corresponding to a higher additive quantity area of the sheet so that the additive is distributed in the predetermined cross-directional pattern. The wet sheet is dewatered and dried to form the nonwoven sheet.

In accordance with a preferred form of the present invention, the stocks are blended before introduction into the headbox at least at one of the positions to adjust the amount of additive in the stock introduced at that position.

In accordance with another preferred form of the invention, the stocks are introduced into the headbox from a plurality of equally spaced apart, discrete discharge openings corresponding to the cross-directional positions along the headbox. It is also advantageous in some applications to segregate the stocks from each of the discharge openings and prevent cross-mixing until the stocks are in the headbox adjacent the wire.

In accordance with another preferred process in accordance with the invention, the solids in the stocks comprise between about 15 and about 90 percent fibrids by weight. Preferably, the fibrids employed are of a non-fusible aromatic polyamide and the stocks further comprise short fibers of a non-fusible aromatic polyamide. Preferred aromatic polyamides are wholly aromatic such as poly-(meta-phenylene isophthalamide).

BRIEF DESCRIPTION OF THE DRAWINGS

The present invention may best be understood by reference to the following detailed description of preferred embodiments when read in conjunction with the accompanying drawings in which.

DETAILED DESCRIPTION

The present invention is useful for the cross-directional distribution of additives in a wide variety of sheets such as papers produced from synthetic fibrous stocks. "Synthetic fibrous stock" is intended to refer to aqueous stocks containing at least a major portion of solids of man-made origin and being capable, with or without a resinous binder, of forming a wet-laid nonwoven sheet. Preferred for the practice of the present invention, are stocks as disclosed in U.S. Pat. No. 2,999,788 which contain fibrids as a binder for the sheets. U.S. Pat. No. 2,999,788 is hereby incorporated by reference. In the preferred embodiment of the invention, the stocks are the type disclosed in U.S. Pat. No. 3,756,908, hereby incorporated by reference, which contain solids with between about 15 percent and about 90 percent by weight of fibrids of a non-fusible aromatic polyamide and about 10 and about 85 percent by weight short fibers (floc) also of a non-fusible aromatic polyamide. It is desirable for both polyamides to be wholly aromatic, most preferably poly-(meta-phenylene isophthalamide). For the practice of the preferred form of the invention, fibrids and floc are prepared as disclosed in U.S. Pat. No. 3,756,908.

In the process of the invention, two or more stocks are prepared with the stocks containing differing additive concentrations, i.e., the concentration of the additive in one stock is higher than in the other stock or is entirely absent from the one stock. It will be understood that for the purposes of the present application, additive is intended to refer to any of a number of materials to be distributed in synthetic nonwoven sheets in a desired cross-directional pattern and which are retained on the wire during sheet formation. Additives include solid materials with a variety of morphologies such as fibrous materials, powders, and platelets. Fibrous additives include materials such as staple, floc, pulp or fibrids which have characteristics which differ from the other fibrous materials in the stocks. Many other types of materials are intended to fall within the meaning of the term additives provided that they are incorporated into the sheet. For example, dyes, colorants and other materials such as dispersions of liquids which become incorporated into or associated with materials which form the sheet can be distributed in a cross-directional pattern in the sheet.

It will also be understood that the present invention is intended to encompass the distribution of more than one additive in cross-directional patterns which may be the same or different for the different additives. As will become more apparent hereinafter, additional stocks are needed to provide separate distribution patterns for each additive desired to be distributed differently from other additives.

Figure 1:
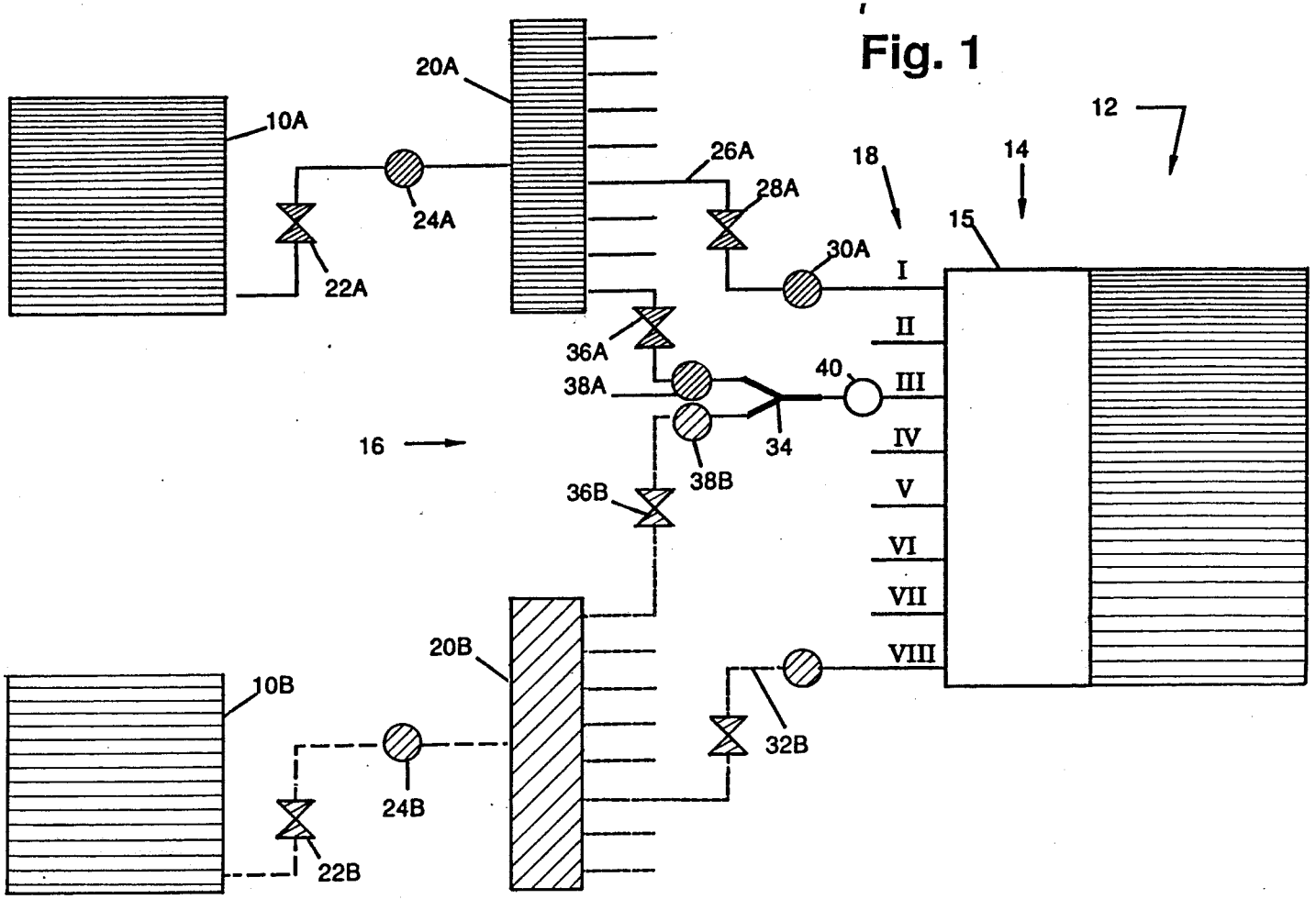
FIG. 1 is a general schematic illustration of apparatus for the practice of the preferred form of the present invention.

Referring now to the drawings and with particularity to FIG. 1 illustrating preferred apparatus generally for distributing one additive in a process in accordance with a process of the invention, it is shown schematically that stocks "A" and "B" with "A" having a higher concentration of an additive than stock "B" are provided in tanks 10A and 10B, respectfully. As will be explained in more detail hereinafter, stocks "A" and "B" are supplied to a continuous paper-forming machine 12 such as a Fourdrinier paper machine having a headbox 14 for depositing the stocks on a wire (not shown) to form a wet sheet from the solids in the stocks.

FIG. 1 illustrates generally that a stock supply system 16 including pumps (not shown) is employed which introduces the two stocks into the headbox 14 at inlet 15 from a plurality of discrete discharge openings 18 into the inlet 15 of the headbox 14. The discharge openings 18 are equally spaced-apart along the width of the headbox with eight such positions being employed in the apparatus of FIG. 1. It will be understood that the number of discharge openings 18 to be employed will vary with the width of the paper being made and the type of pattern to be provided for the additive in the paper consistent with good flow distributor design practices.

In accordance with the process of the invention, the amount of solids introduced into the inlet by each of the discharge openings 18 (identified individually as I–VIII) into the headbox is generally equal so that the wet sheet formed on the wire is generally uniform in weight along its width although the amount of additive in the streams varies to produce the cross-directional distribution pattern. After discharge into the inlet 15 of the headbox 14, the stock flows to the headbox 14 and onto the wire at a position along the width of sheet corresponding to the position of discharge into the head box inlet and the concentration of the additive in the stock at that discharge opening 18 determines the amount of additive in the sheet. Depending on the type of distribution pattern desired, it may be necessary to minimize the level of the pond in the headbox so that the retention time in the headbox is decreased to minimize cross-mixing. Nevertheless, for some patterns, at least limited cross-mixing may be desired. In some paper machines, the wire is normally oscillated to promote cross-mixing to decrease sheet directionality. In general, this is undesirable in the practice of the present invention and the oscillation should not be used. In addition, it is sometimes desirable to provide baffles or partitions in the paper machine headbox inlet 15 which provide confined flow areas of approximately equal size corresponding to each of the discharge openings 18 so that the stock introduced into the headbox from that opening is deposited on the wire in a localized fashion. If desired, the partitions extend substantially though the headbox inlet to segregate streams of the stock from each of the discharge openings 18 until the streams are very close to the wire and cross-mixing is prevented until that point.

The stock supply system 16 illustrated includes two flow distribution devices 20A and 20B suitably provided by headers which are capable of dividing aqueous slurries into a number of different flows. Additional flow distribution devices and additional separate stock tanks will be needed for additional additives to be distributed in different patterns. Flow distribution device 20A is used to divide a flow from stock tank 10A containing the maximum additive concentration into a number of streams flowing to the discharge openings 18 in the headbox inlet 15. Similarly, flow distribution device 20B provides one or more flows of the stock flowing from the tank 10B containing minimum additive as is necessary to achieve the desired pattern of additive distribution. Valves 22A and 22B and flow meters 24A and 24B are preferably used to control the flow from the tanks 10A and 10B to the flow distribution devices 20A and 20B.

As will become more apparent hereinafter, one or more flows from the flow distribution devices 20A and 20B are introduced to the discharge openings 18 in the paper machine headbox. For some applications, where a maximum additive concentration is desired at a discharge opening 18, a direct connection such as connection 26A between a flow from the flow distribution device to discharge opening I is provided with valve 28A and flow meter 30A for control of the flow. A similar connection 32B is illustrated for the minimum additive concentration at discharge opening VIII. When the amount of additive at a position is to be intermediate the maximum and minimum, two flows from the flow distribution devices 20A and 20B are tied together with a Y-connector 34 connected to discharge opening III so that the stocks are blended together to result in an intermediate amount of additive at that position. Again, it is desirable to use a maximum additive control valve 36A, a minimum additive control valve 36B, flow meters 38A and 38B on those streams and a combined flow meter 40. It is thereby possible to monitor and control the flows to provide the appropriate amount of additive while maintaining the solids in the paper generally uniform across the sheet width. Other means of calibrating the flows can be used such as by visually comparing flows of water flowing from the distribution devices when disconnected. It is also desirable to monitor the basis weight of the paper as formed to insure uniform deposition of solids on the wire and to monitor the additive distribution pattern when possible.

Figure 2:
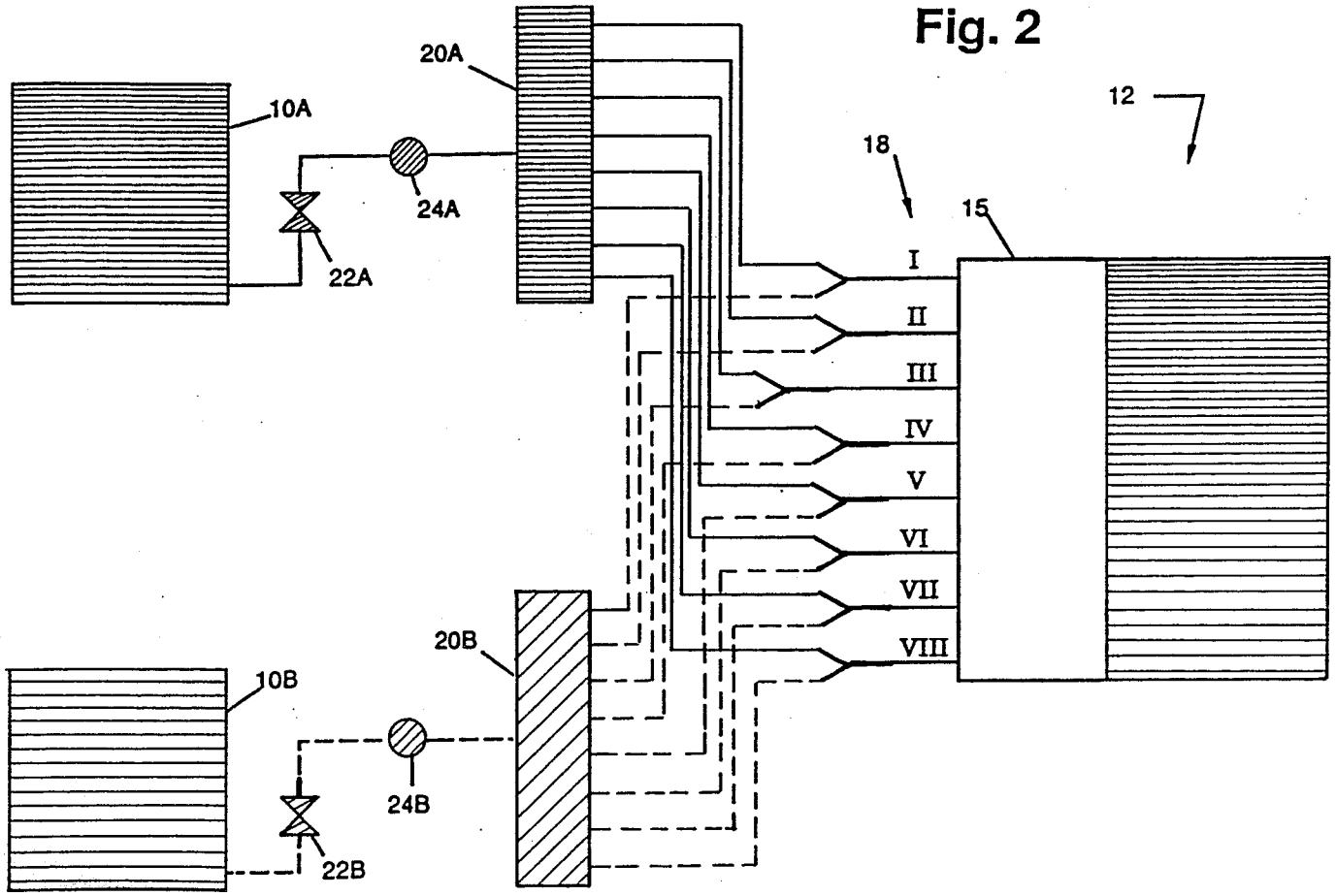
FIG. 2 illustrates apparatus for employing a preferred process of the invention capable of producing a linear cross-distribution profile of the additive.

Referring now to FIG. 2, there is shown a piping scheme from the flow distribution devices to the headbox which can be used to produce a linear additive distribution profile in the paper, i.e., the concentration of additive increases in a linear fashion from one side to the other. To accomplish this, each of the eight lines from the flow distribution devices 20A and 20B is tied to a Y-connector before reaching the discharge openings 18 of the headbox. Although the valves and flowmeters are not illustrated in FIG. 2 to simplify the illustration, the flow of slurry A from the tank 10A predominates over the flow of slurry B in the Y-connector leading to discharge opening I. Similarly, at the Y-connector leading to discharge opening II, slurry A is somewhat decreased and the flow of B is increased to decrease the amount of additive in the stock. Thus, by continuing this progression, an essentially linear profile can be established using this piping scheme until the Y-connector is reached for discharge opening VIII which predominantly introduces slurry B into the discharge opening.

Figure 3:
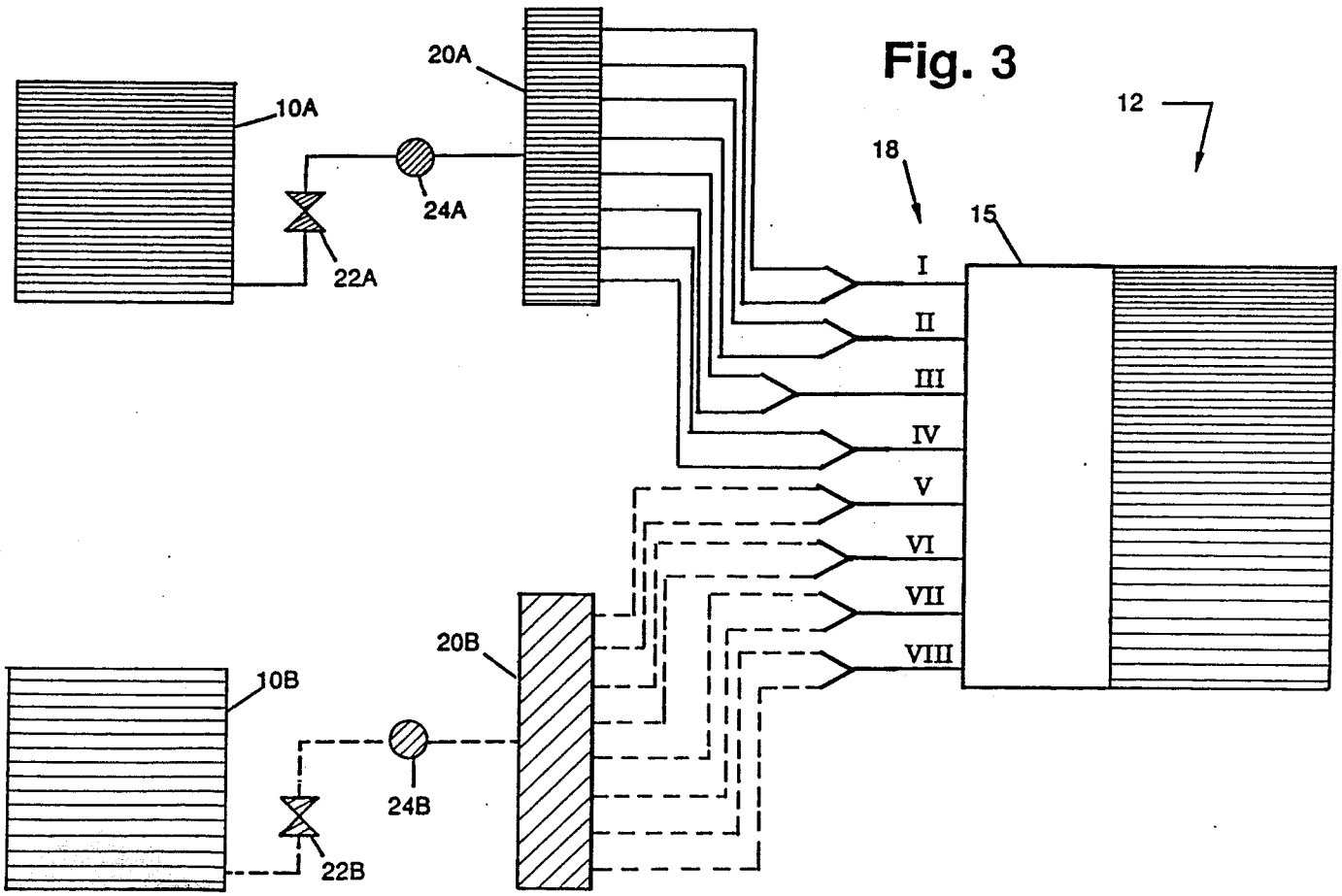
FIG. 3 illustrates apparatus for producing an "S" curve additive distribution profile.
Figure 4:
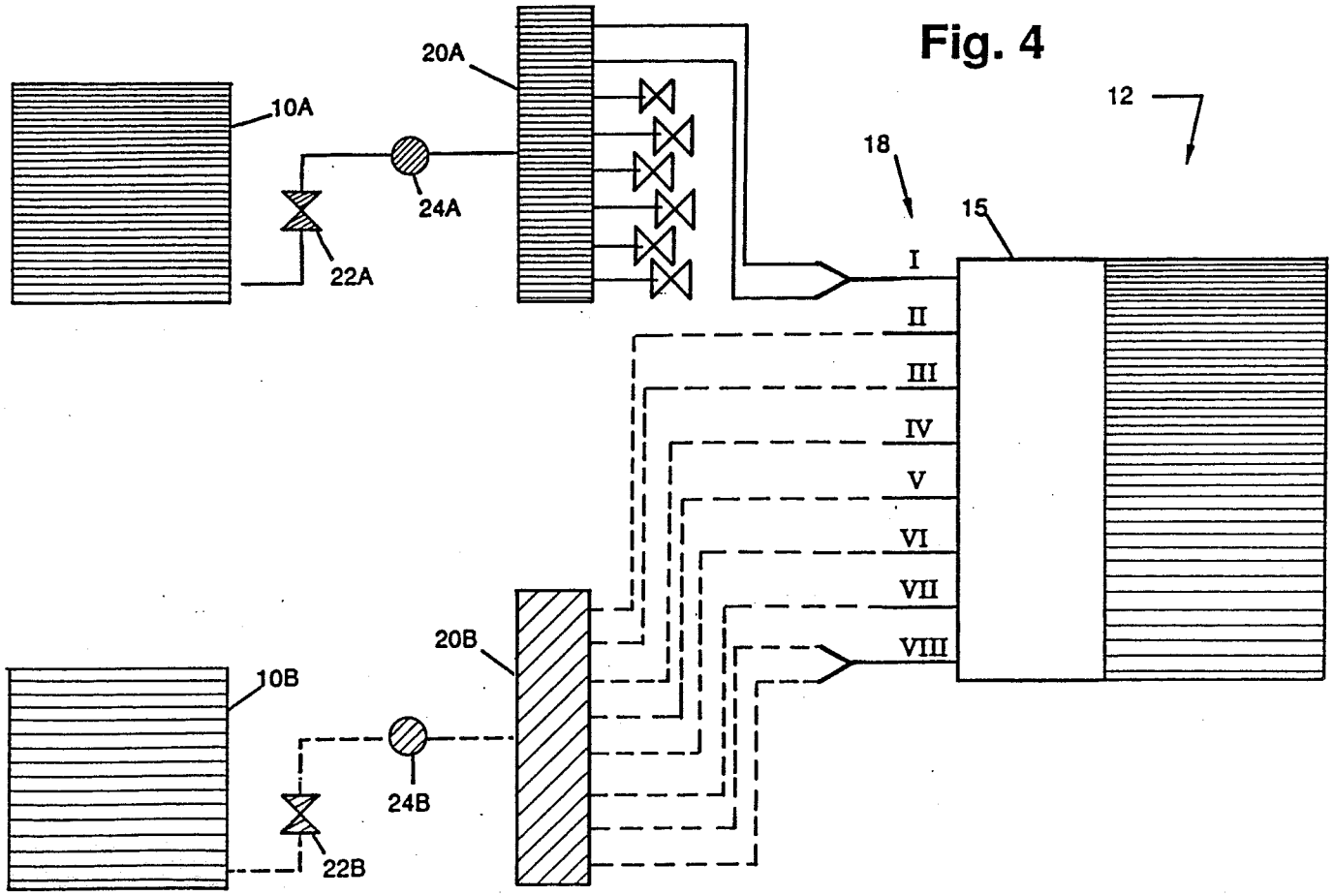
FIG. 4 illustrates apparatus for producing an exponential distribution profile of an additive.

FIGS. 3 and 4 illustrate other possible distribution pattern profiles such as the S-curve profile illustrated in FIG. 3 and the exponential profile illustrated in FIG. 4. For an S-curve profile, half of the discharge openings (I–IV) are supplied with slurry A and half of the discharge openings (V–VIII) are supplied with slurry B. For an exponential profile, one of the discharge openings I is supplied with slurry A whereas the remainder (II–VII) are supplied with slurry B as shown in FIG. 4.

Figure 6:
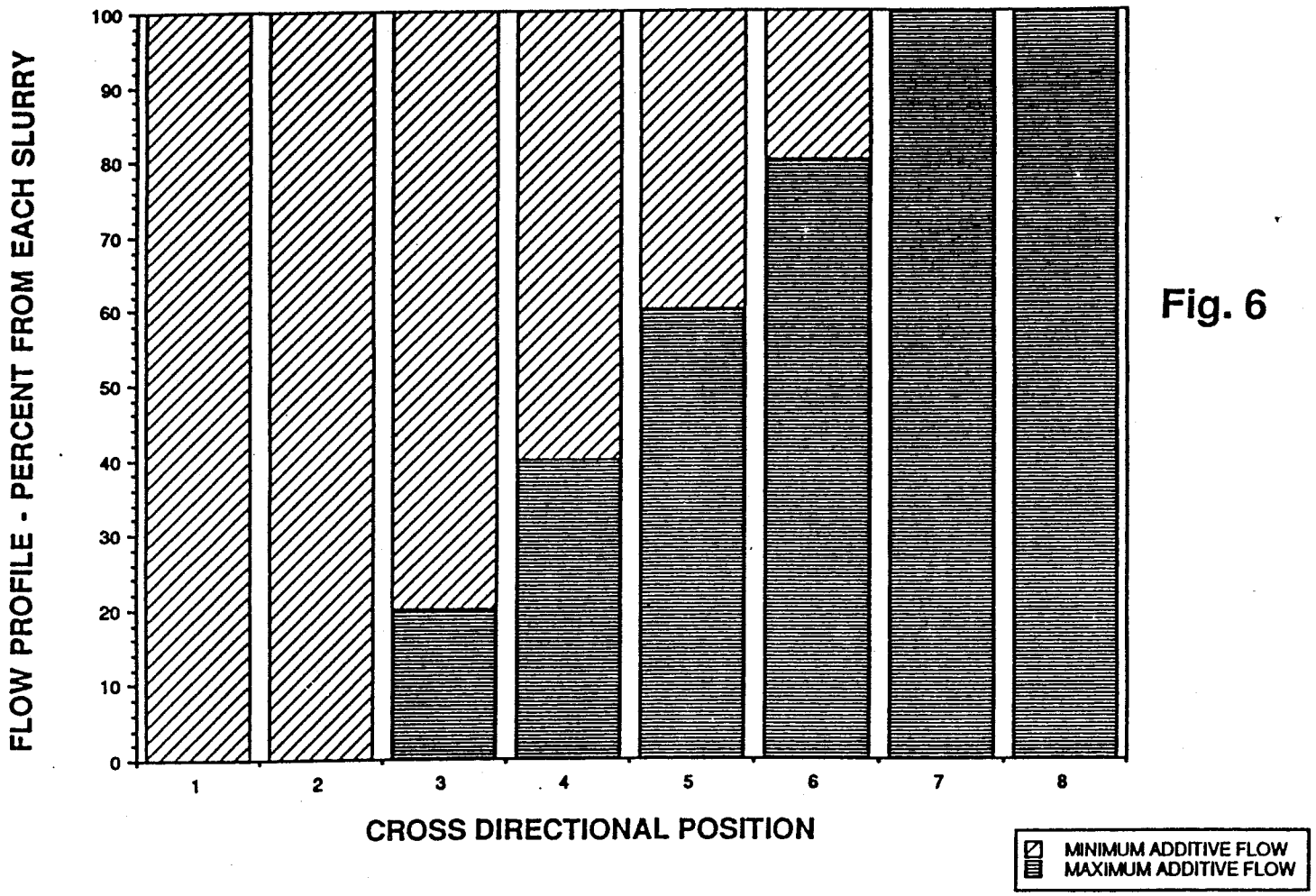
FIG. 6 illustrates relative slurry flows using the apparatus of FIG. 2 to produce an alternate "S" curve additive distribution profile.

FIG. 6 illustrates relative flows using the apparatus as set up in FIG. 2 to produce an alternate S-curve profile. Positions I and II have full flows of the minimum additive concentration stock, positions VII and VIII have full flows of the maximum additive concentration stock, and positions III–VI have flows of each slurry progressively containing more additive.

The method of the invention provides a highly versatile means of distributing additives in a cross-direction in synthetic, wet-laid, non-woven sheets. Any of a wide variety of distribution patterns can be produced including differing patterns of more than one additive. Moreover, existing papermaking equipment can be adapted without extensive modification to practice the present invention.

The invention is illustrated in the following examples in which calibration of the flows before papermaking was performed as follows:

For the linear profile, the piping was connected as shown in FIG. 2, with each "Y" connector connecting between each of flow distribution devices. Flow meters were provided between the pump discharge and the flow distribution devices. The outlet from each of the "Y" connectors was left open. A holder was used to orient the outlets of the "Y" connectors generally vertically in a straight line and each supply tank was filled with water. First, water from one tank was pumped through the parallel group "Y" connectors at 380 1/min (100 gal/min). The individual control valves for each individual stream were adjusted to give a linearly increasing arc of water leaving the line of "Y" connectors. The process was repeated for the other tank with water being pumped again at 380 1/min (100 gal/min). The streams flowing from the outlets of the "Y" connectors were adjusted to give a similar linear arc, but in the opposite direction to the first. Finally the total flow was checked by pumping both streams at a combined flow of 760 1/min (200 gal/min), i.e., 380 1/min per stream (100 gal/min per stream) to verify the total flow gave a flat profile of water arcs.

Similar procedures were used for the other additive distribution profiles except that, for some of the profiles, the arcs of full flow streams from one of the tanks were compared with mixed or full flow streams from the other tank.

The calibrated system was reconnected to the headbox and the total flows to the flow distribution devices were monitored and controlled for each stock. Adjustments of the individual streams to "fine tune" the profile is done by color measurement (with the eye and by a colorimeter) where color differences are visible. The basis weight profile of the paper is monitored by the use of a basis weight sensor such as those commercially available from Measurex or Accuray.

EXAMPLE I

Poly-(meta-phenylene isophthalamide) fibrids produced in accordance with the procedures described in U.S. Pat. No. 3,756,908 were put in to a 26,600 liter (7000 gal) tank. Sufficient 0.64 cm (¼") poly-(meta-phenylene isophthalamide) floc was added to the 26,600 liter (7000 gal) tank to obtain a 54.64% fibrids/45.36% floc composition (consistency of 0.43%). This slurry was identified as "A". A similar slurry was made up in a 13,300 liter (3500 gal) tank. Sufficient blue dye was added to the 13,300 liter (3500 gal) tank to dye the slurry blue. This slurry was identified as "B" and had a consistency of 0.42%.

Figure 5:
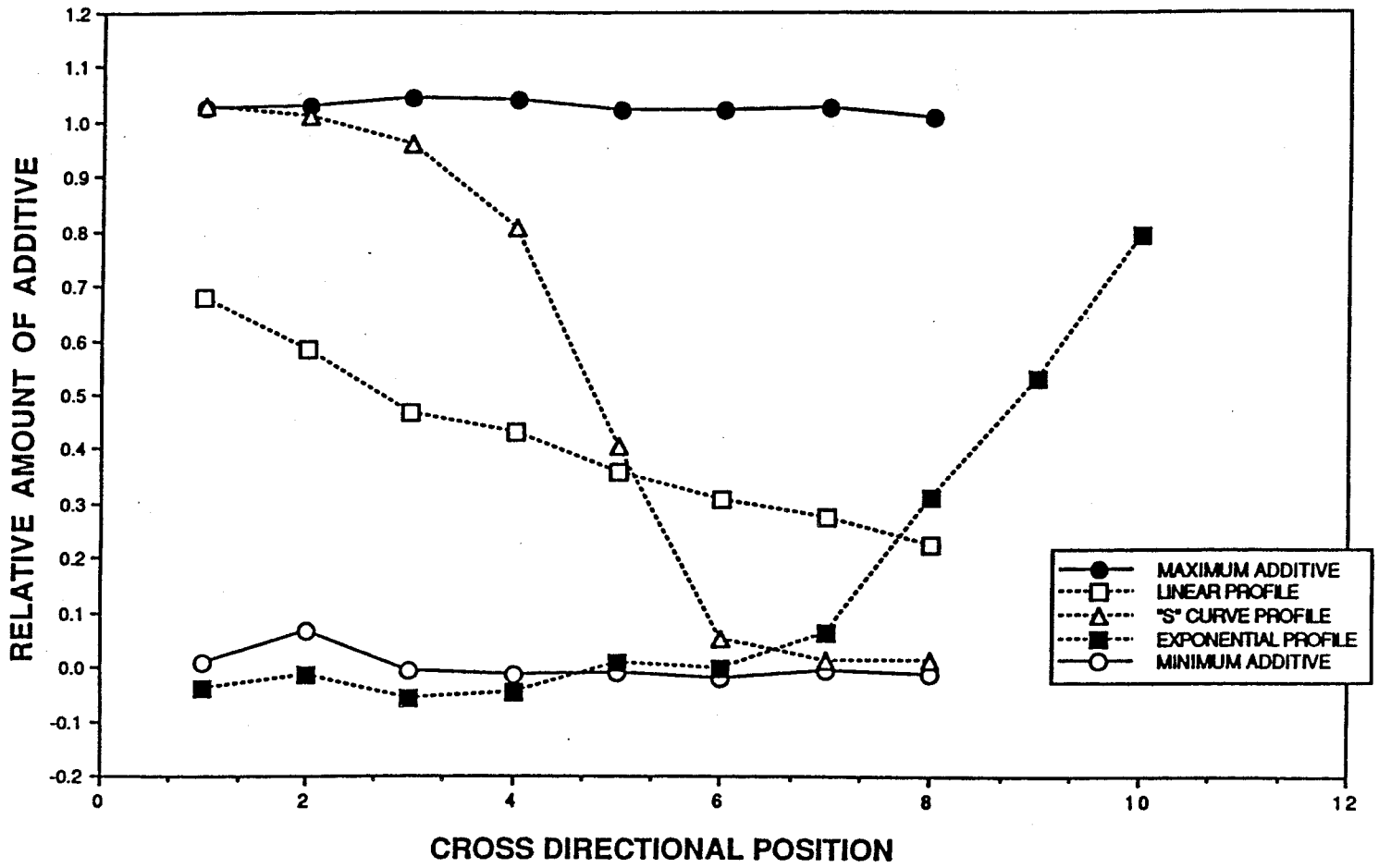
FIG. 5 illustrates various additive distribution profiles produced in accordance with Examples 1–2.

To produce a linear profile of blue dye distribution having more of the blue dye slurry than the other slurry which had not been dyed, the headbox inlet of a 81 cm (32") Fourdrinier paper machine was connected to the "Y" connectors of both the "A" and "B" slurries as shown in FIG. 2. The standard header was removed from the headbox and eight openings of the inlet were connected to the "Y" connectors. The paper machine was used to produce 61 cm (24") wide paper having a weight of 41 g/m$^2$ (1.2 oz/sq yd) sheet at 61 m/min (200 ft/min). The total flow of the "A" slurry was 114 1/min (30 gal/min) and the total flow of the "B" slurry was 342 1/min (90 gal/min). No additional dilution water was added to the headbox. The individual stream control valves were adjusted to fine-tune the profile to adjust the blue color and the basis weight was monitored using a basis weight sensor and the control valves were adjusted to keep the weight of the paper uniform. FIG. 5 illustrates the linear profile obtained (relative amount of additive) when determined using a colorimeter to read the Hunter "b" scale in the cross-direction of the sheet. Controls having maximum and minimum additive concentrations are also shown in FIG. 5.

An "S" curve profile was produced on the same machine using a piping system where four of the headbox inlet lines (back side) were fed from slurry "A" exclusively and the other four the inlet lines (front side) were fed from slurry "B" exclusively as shown in FIG. 3. Individual stream control valves were adjusted to fine-tune the profile. The paper machine produced a 41 g/m$^2$ (1.2 oz/sq yd) sheet at 61 m/min (200 ft/min). The total flow of each slurry was 228 1/min (60 gal/min).

The profile was again determined by using a colorimeter to read the Hunter "b" scale in the cross-direction of the sheet and this data is plotted (relative amount of the additive) in FIG. 5.

EXAMPLE II

As in Example 1, poly-(meta-phenylene isophthalamide) fibrids were put into a 26,600 liter (7000 gal) tank. Sufficient 0.64 cm (¼") poly-(meta-phenylene isophthalamide) floc was added to the 26,600 liter (7000 gal)

tank to obtain a 51% fibrids/49% floc composition having a consistency of 0.32%. This slurry was identified as "A". Poly-(meta-phenylene isophthalamide) tow was dyed black and then cut to 0.64 cm (¼") lengths. Fibrids were put into a 13,300 (3500 gal) tank and sufficient standard 0.64 (¼") poly-(meta-phenylene isophthalamide) floc and black dyed poly-(meta-phenylene isophthalamide) floc were added to obtain a 51% fibrids/39% standard floc/10% black floc composition having a consistency of 0.33%. This slurry was identified as slurry "B".

To produce paper having a black dyed floc distribution with a profile having an exponential slope, the same paper machine as in Example 1 was used with only a single headbox inlet line being fed from slurry "B". FIG. 4 illustrates diagrammatically the piping scheme used in which all other inlet lines were supplied from slurry "A".

The paper machine produced a 76 cm (30") wide sheet having a weight of 41 g/m$^2$ (1.2 oz/sq yd) at 61 m/min (200 ft/min). The total flow of the "A" slurry was 547 l/min (144 gal/min) and the total flow of the "B" slurry was 80 l/min (21 gal/min). No additional dilution water was added to the headbox. The individual stream control valves were adjusted to fine-tune the profile.

The resulting profile was determined using a colorimeter measuring the Hunter "L" scale (varies from white to black) at various points in the cross direction of the sheet and the results are reported in FIG. 5.

We claim:

1. A process for making an elongate, nonwoven flexible sheet from synthetic fibrous stocks, said sheet having an additive distributed in a predetermined cross-directional pattern of areas of higher and lower additive quantities across the width of the sheet, said process comprising:

providing at least two synthetic fibrous stocks each containing solids capable of forming an elongated, nonwoven flexible sheet, one of said stocks containing said additive in a concentration higher than in the other stock;

supplying each of said stocks to a paper machine having a headbox for depositing said stocks on a wire to form a wet sheet of said solids, said stocks being introduced into said headbox from a plurality of cross-directional positions equally spaced-apart along said headbox with a generally equal amount of solids being introduced at each position to produce a wet sheet generally uniform in weight per unit of area across its width, said stock with the higher concentration of additive being introduced in higher quantity than the other stock at least at one of said cross-directional positions corresponding to a higher additive quantity area of said sheet so that the additive is distributed in said predetermined cross-directional pattern;

monitoring the weight per unit of area across the width of the wet sheet being produced and controlling the supplying of each of said stocks into said headbox in response to said monitoring of weight per unit of area to maintain the weight per unit of area generally uniform across its width as the sheet is produced; and dewatering and drying said wet sheet to form said nonwoven sheet.

2. The process of claim 1 wherein said stocks are blended before introduction into said headbox at least at one of said positions to adjust the amount of said additive in said stock introduced at said position.

3. The process of claim 1 wherein said stocks are introduced into said headbox from a plurality of equally spaced-apart, discrete discharge openings corresponding to said cross-directional positions along said headbox.

4. The process of claim 3 wherein said stocks introduced from said discharge openings are segregated and prevented from cross-mixing until said stocks are in said headbox adjacent said wire.

5. The process of claim 1 wherein said solids comprise between about 15 and about 90% fibrids by weight.

6. The process of claim 5 wherein said solids in said stocks comprise short fibers and fibrids of a nonfusible aromatic polyamide.

7. The process of claim 6 wherein said polyamides are wholly aromatic.

8. The process of claim 7 wherein said wholly aromatic polyamide is poly-(meta-phenylene isophthalamide).

9. The process of claim 1 further comprising monitoring the distribution of the additive across the width of the wet sheet and controlling the supplying of each of said stocks in response to said monitoring of the additive distribution to maintain said predetermined cross-directional pattern of areas of higher and lower additive quantities across the width of the sheet as the sheet is produced.

* * * * *